US007670648B2

(12) United States Patent
Shipton et al.

(10) Patent No.: US 7,670,648 B2
(45) Date of Patent: Mar. 2, 2010

(54) METHOD OF FORMING A DIFFUSION BARRIER ON A TITANIUM ALLOY SUBSTRATE

(75) Inventors: Mark H Shipton, Bristol (GB); Terence W Maber, Bristol (GB)

(73) Assignee: Rolls-Royce, PLC, London (GB)

( * ) Notice: Subject to any disclaimer, the term of this patent is extended or adjusted under 35 U.S.C. 154(b) by 1388 days.

(21) Appl. No.: 10/689,100

(22) Filed: Oct. 21, 2003

(65) Prior Publication Data

US 2004/0086730 A1 May 6, 2004

(30) Foreign Application Priority Data

Nov. 5, 2002 (GB) ..... 0225670.9

(51) Int. Cl.
*B05D 3/02* (2006.01)

(52) U.S. Cl. ..... 427/376.4; 427/372.2; 427/375; 427/376.2

(58) Field of Classification Search ..... 427/372.2
See application file for complete search history.

(56) References Cited

U.S. PATENT DOCUMENTS

| | | | | |
|---|---|---|---|---|
| 3,395,027 | A * | 7/1968 | Klotz | 427/372.2 |
| 3,434,813 | A * | 3/1969 | Bomberger, Jr. | 428/658 |
| 3,857,717 | A * | 12/1974 | Wydra et al. | 428/325 |
| 4,243,434 | A | 1/1981 | Hartley et al. | |
| 5,803,990 | A * | 9/1998 | Mosser et al. | 148/261 |
| 5,908,516 | A * | 6/1999 | Nguyen-Dinh | 148/421 |
| 6,133,498 | A | 10/2000 | Singh et al. | |
| 2002/0107133 | A1 * | 8/2002 | Troczynski et al. | 501/1 |
| 2003/0082053 | A1 * | 5/2003 | Jackson et al. | 416/224 |

FOREIGN PATENT DOCUMENTS

| | | |
|---|---|---|
| EP | 0 358 338 A2 | 3/1990 |
| GB | 879715 | 10/1961 |
| GB | 2 286 977 A | 9/1995 |
| JP | A 49-26335 | 3/1974 |
| JP | A 49-26425 | 7/1974 |
| JP | A 51-54846 | 5/1976 |
| JP | A 58-84980 | 5/1983 |
| JP | A 63-18082 | 1/1988 |
| JP | A 2-92965 | 4/1990 |
| RO | 83341 | 7/1982 |
| SU | 1562362 A1 | 5/1990 |

* cited by examiner

*Primary Examiner*—Timothy H Meeks
*Assistant Examiner*—Michael G Miller
(74) *Attorney, Agent, or Firm*—Oliff & Berridge, PLC

(57) ABSTRACT

A phosphate bonded ceramic is used to provide a diffusion barrier on a titanium alloy substrate, conferring degradation (eg oxidation) resistance to the alloy. The substrate may, for example, be an aerospace component such as a part of a gas turbine engine.

13 Claims, No Drawings

METHOD OF FORMING A DIFFUSION BARRIER ON A TITANIUM ALLOY SUBSTRATE

The present invention relates to a method of forming a diffusion barrier on a titanium alloy substrate, and a degradation resistant titanium alloy structure formed thereby. In one particularly preferred form of the invention, the diffusion barrier serves to protect the alloy against the damaging effects of α-case oxide formation in high temperature (eg above about 650° C.) oxidative or corrosive environments.

The strength and low density of titanium alloys means that they are widely used in a number of aerospace applications, including gas turbine engine compressor blades, vanes, and related hardware.

At low temperatures, titanium alloys are intrinsically oxidation resistant through the formation of a stable oxide. However, above approximately 400° C., oxygen diffuses through the oxide scale, forming relatively brittle regions in the alloy. Such regions are prone to cracking and failure.

In addition, titanium alloys can be susceptible to degradation as a result of attack by aggressive media, whether gas, liquid or solid. Examples of such damaging media include halogen-containing or halogen-compound-containing media, particularly those in which the halogen atom is chlorine or fluorine.

The prior art teaches a number of proposals for improving high temperature resistance to oxidation, cracking and other degradation in titanium alloys.

In U.S. Pat. No. 2,992,135, for example, Finlay teaches the application of various metallic coatings to a titanium base. These coatings comprise metals such aluminium, tin, copper and lead which form protective alloys with the titanium metal. Methods of application include applying the metal coating directly from a molten bath.

In U.S. Pat. No. 3,765,954, Tokuda et al teach the preparation of surface-hardened titanium alloys by coating the titanium with a substitutional metal and heating the coated metal in a nitrogen atmosphere to nitride the substitutional metal. A hardened layer is formed, which is richer in relatively stable beta phase than the base metal.

WO 94/18359 discloses the formation of a platinum aluminide diffusion barrier on a titanium substrate by the sequential deposition of a platinum layer followed by an aluminium layer. This two-layer deposited system is then subjected to a reaction treatment consisting of heating the deposited materials under moderate vacuum for a period of two hours at a temperature of 750° C., causing the formation of a platinum aluminide diffusion barrier. Deposition of the layers is stated to be by RF biased DC sputtering.

The disclosures of all the above items of prior art are incorporated herein by reference.

All of the prior art techniques suffer from certain disadvantages. Generally speaking, it has not been possible to combine an effective anti-degradation and cracking diffusion barrier treatment with a convenient and relatively cheap technique for applying the diffusion barrier to the surface of the titanium alloy, particularly in the case of titanium alloy structures that are used in high temperature oxidative environments.

While it is possible to use other components to act as oxygen diffusion barriers most react with titanium in the temperature range in which the present invention is intended to operate.

A common problem with coatings which do not react with the titanium alloy substrate at elevated temperatures (such as aluminium) is that they form oxides (eg $AlO_2$) which are brittle and cause fatigue damage to the surface of the titanium substrate, thereby increasing the propensity of the component to fail.

An additional problem with coating titanium alloy substrates with metallic based coatings is that many metals will diffuse into the substrate and cause fatigue damage.

The present invention is based on our surprising finding that an effective diffusion barrier comprising a phosphate bonded ceramic may be formed on a titanium alloy substrate.

According to a first aspect of the present invention, there is provided a method of forming a diffusion barrier on a titanium alloy substrate, the method comprising applying to the titanium alloy substrate a coating comprising a source of a ceramic-forming metal oxide and a source of a phosphate binder for the metal oxide, and causing the metal oxide and the phosphate to cure to form a diffusion barrier comprising a phosphate bonded ceramic on the titanium alloy substrate.

The term "diffusion barrier" used herein refers to a material overlying a surface of the titanium alloy substrate, the material having a sufficiently low permeability to a medium capable of degrading the substrate under the intended conditions of use of the substrate that the medium is substantially prevented from contacting the titanium alloy substrate, at least in degradative amounts.

The term "titanium alloy" used herein refers to an alloy in which the component present in the largest weight proportion is titanium.

The term "source of a ceramic-forming metal oxide" (abbreviated to "oxide source") used herein refers to any compound or mixture which acts to provide a metal oxide or a precursor thereof capable of partaking in the curing reaction with a phosphate source, to result in a phosphate bonded ceramic.

The term "source of a phosphate binder" (abbreviated to "phosphate source") used herein refers to any compound or mixture which acts to provide a phosphate ions capable of partaking in the curing reaction with the metal oxide, to result in a phosphate bonded ceramic.

The coating is preferably applied as a liquid (eg aqueous) composition containing the components, which is then allowed to cure for a sufficient period of time (eg between about 1 hour and about 3 weeks), depending on the nature of the coating. The composition may be applied to the titanium alloy substrate in one or more application steps. If more than one application step is used, the components of the coating may be built up in the successive steps, eg by applying different materials in each step. In some cases, the curing reaction to form the phosphate bonded ceramic takes place at normal temperatures. In those cases, the reactants normally have to be stored separately and either applied separately or mixed into the coating composition immediately before application. In other cases, curing needs to be initiated, for example by pressure and/or thermally by heating to an elevated temperature (eg above about 50° C., more typically between about 100 and about 500° C.). In those cases, the coating composition can be prepared in advance, shipped and stored prior to application in one coating step.

The titanium alloy substrate preferably comprises an aerospace component or a portion thereof.

According to a second aspect of the present invention, there is provided a degradation resistant titanium alloy structure (eg an aerospace component or a portion thereof) having a diffusion barrier disposed thereon, wherein the diffusion barrier comprises a phosphate bonded ceramic.

The structure according to the second aspect of the present invention is formable by the method of the first aspect, and is preferably formed using that method.

According to a third aspect of the present invention, there is provided a degradation resistant aerospace component comprising a titanium alloy substrate and a substantially uniform diffusion barrier disposed thereon, wherein the diffusion barrier comprises a phosphate bonded ceramic.

The diffusion barrier preferably has a thickness in the range of about 1 to about 10 μm.

In the structure or component according to the second and third aspects of the present invention, the diffusion barrier preferably consists essentially of a phosphate bonded ceramic, with less than about 10%, more particularly less than about 5%, by weight of other components (based on the weight of the diffusion barrier).

Preferably, the degradation resistant structure or component exhibits substantially no diffusion of constituents of the diffusion barrier into the titanium alloy substrate and substantially no detrimental reaction between constituents of the diffusion barrier and the titanium alloy substrate.

The titanium alloy of the substrate is suitably of relatively low density, for example less than about 7 $gcm^{-3}$, less than about 6 $gcm^{-3}$ or less than about 5 $gcm^{-3}$. The titanium alloy suitably has a relatively high melting point or melting range. For example, the melting point or midpoint of the melting range may suitably be above about 1000° C., for example above about 1300° C., more preferably above about 1400° C., and most preferably above about 1500° C.

The titanium alloy comprises titanium as the main component and any other suitable metal or metals as a further component or components. It will be appreciated that the alloy may also comprise semi- and non-metallic components in addition to metallic components. These semi- and non-metallic components may typically be present in lower amounts than the main metallic component(s), for example less than about 5% by weight, less than about 3% by weight or less than about 1% by weight.

In a preferred embodiment, the titanium alloy is substantially in the beta form.

The alloy comprises titanium as the main component and preferably one or more subsidiary components selected from the group consisting of aluminium, beryllium, bismuth, chromium, cobalt, gallium, hafnium, iron, manganese, molybdenum, niobium, nickel, oxygen, rhenium, tantalum, tin, tungsten, vanadium and zirconium. This alloy may also suitably comprise one or more semi- or non-metallic elements selected from the group consisting of boron, carbon, silicon, phosphorous, arsenic, selenium, antimony and tellurium. These elements may serve to increase the oxidation, creep or burning resistance of the alloy.

Titanium may be present in such a titanium alloy in an amount greater than about 40% by weight, for example greater than about 50% by weight, greater than about 60% by weight or greater than about 70% by weight and in some embodiments may be present in an amount greater than about 80% by weight.

The amount in which the subsidiary component or components are present is determined by the use to which the alloy will be put, as will be well understood by those skilled in this art. For example, the alloy may be a ternary alloy comprising titanium, vanadium and chromium. Certain compositions of this type are especially preferred for certain applications wherein the titanium is present substantially in the beta form under most temperature conditions ie has less than about 3 wt % alpha phase titanium, preferably less than about 2 wt % alpha phase titanium. Such beta titanium alloys are based on ternary compositions of titanium-vanadium-chromium which occur in the titanium-vanadium-chromium phase diagram bounded by the points Ti-22V-13Cr, Ti-22V-36Cr, and Ti-40V-13Cr. These compositions are known to have useful mechanical properties such as high creep strength and a lack of combustibility at temperatures of up to at least about 650° C. In such compositions, the titanium is preferably present in an amount greater than about 40% by weight, for example greater than about 50% by weight. The chromium is preferably present in an amount greater than about 10% by weight, for example greater than about 15% by weight or greater than about 25% by weight. This concentration of chromium is necessary to provide the required non-burning characteristics of the alloy at these high temperatures. Vanadium may be present in an amount greater than about 20% by weight, for example greater than 25% by weight or greater than about 30% by weight. A specific alloy of this type has a composition comprising about 50 wt % titanium, about 35 wt % vanadium and about 15 wt % chromium.

In other applications, the elements of the alloy will be significantly different. For example, the alloy may comprise titanium and other metals or semi-metals selected from the group consisting of aluminium, chromium, copper, iron, molybdenum, niobium, silicon, carbon, tin, vanadium and zirconium. In such alloys, aluminium is preferably present in an amount less than 10 wt %, for example less than 8 wt %; chromium is preferably present in an amount less than 10 wt %, for example less than 8 wt %; copper is preferably present in an amount less than 5 wt %, for example less than 3 wt %; iron is preferably present in an amount less than 5 wt %, for example less than 3 wt %; molybdenum is preferably present in an amount less than 10 wt %, for example less than 8 wt %; niobium is preferably present in an amount less than 6 wt %, for example less than 4 wt %; silicon is preferably present in an amount less than 2 wt %, for example less than 1 wt %; carbon is preferably present in an amount less than 1 wt %, for example less than 0.5 wt %; tin is preferably present in an amount less than 16 wt %, for example less than 12 wt %; vanadium is preferably present in an amount less than 15 wt %, for example less than 10 wt %; and zirconium is preferably present in an amount less than 8 wt %, for example less than 6 wt %. A specific example of such an alloy is Ti-6Al-4V or IMI834 (Ti-5.8Al-4Sn-3.5Zr-0.7Nb).

Titanium alloys are known to be generally susceptible to oxidation damage through the formation of the so-called α-case oxide layer. The diffusion barrier established according to the present invention is found to substantially restrict such oxidation damage in titanium alloys.

Where the titanium alloy substrate comprises an aerospace component or portion thereof, the component is preferably a component of an aero-engine which in use may be exposed to conditions of relatively high temperature (eg above about 400° C., particularly above about 650° C.), eg casings, compressor drums, vanes, discs, blades, shafts, plugs or nozzles.

The phosphate bonded ceramic diffusion barrier according to the present invention is normally employed on metallic surfaces as a bonding coat or seal to which other coatings are applied and to act to prevent galvanic corrosion. It is normally applied as a very thin coat, and is not be expected to act as a protective coating by itself. The surprising result provided by the present invention, wherein the coating combines with oxides formed on the surface of the titanium alloy to which it is applied, considerably reduces the extent to which oxygen diffuses into the titanium alloy.

The composition of the diffusion barrier coating of the present invention suitably comprises a liquid carrier entraining the oxide source and the phosphate source, enabling the components of the diffusion barrier to be applied in a generally uniform and well dispersed manner as the coating on the alloy substrate surface before curing takes place.

It is preferred that the coating composition is applied to the alloy substrate in one step, with all the components of the diffusion barrier present in that step. Such a coating composition will typically either be prepared immediately before application, or will use components that require an initiation step to promote curing. The choice between different systems is well within the ability of those of skill in this art.

The physico-chemical properties of the carrier will be selected according to the specific conditions of use, as will be well understood by those of skill in this art.

For example, the carrier may conveniently be chosen such that the coating composition has a rheology (ie viscosity and thixotropy) providing good nozzle-non-blocking sprayability or good brush-, blade- or roller-spreadability onto the alloy substrate, resulting in good, uniform application to the substrate surface. The viscosity of the liquid carrier may be selected to restrict sedimentation of any entrained particles prior to use.

The carrier may suitably comprise rheology modifiers such as clays (eg organoclays such as bentonite), to assist in maintaining the desired viscosity and thixotropy.

The surface tension of the coating composition may, if desired, be adjusted by means of surfactants, to optimise the application performance of the composition and the uniformity of the applied coating prior to reaction treatment to form the diffusion barrier. Such adjustments will be well within the capability of those skilled in this art.

The oxide source may suitably be selected from an inorganic oxide or hydroxide, and more particularly an oxide or hydroxide of a transition metal, an alkali metal, a Group IIIB metal or an alkaline earth metal. Suitable oxides and hydroxides include, for example, those of magnesium, aluminium, iron, chromium, sodium, zirconium or calcium, or any mixture or chemical or physical combination thereof. An oxide may suitably be used in powder form, and may for example be pre-treated (eg heated, calcined and/or washed), which has been found in some cases to improve the resultant ceramic. Where the oxide is a calcined oxide, the calcination temperature may suitably be in the range of about 500 to about 1500° C.

The phosphate source will preferably comprise phosphoric acid and/or a phosphate, such as, for example, a phosphate of potassium, aluminium, ammonium, beryllium, calcium, iron, lanthanum, lithium, magnesium, magnesium-sodium, magnesium-potassium, sodium, yttrium, zinc, zirconium, or any mixture or chemical or physical combination thereof. The phosphate may suitably be an acid phosphate. The phosphate source may be present in an amount of at least about 10 wt %, for example at least about 15 wt %. The phosphate source is normally present in an amount up to about 35 wt %, for example up to about 25 wt %. In a preferred embodiment, the phosphate source comprises phosphoric acid, magnesium hydrogen phosphate, or a mixture thereof.

The coating composition is preferably a liquid aqueous dispersion, which preferably has an acidic pH. This dispersion normally has a water content of at least about 40 wt %, for example at least about 45 wt %. The water content is normally up to about 75 wt %, for example up to about 65 wt %, preferably up to about 55 wt %.

The coating composition may, if desired, include a cure-rate retardant, as will be known to those skilled in this art. Retardants serve to reduce the rate of ceramic formation, which can extend the period of time over which the pre-cure composition remains in a fluid state for application to the titanium alloy substrate and can reduce the maximum temperature attained in the strongly exothermic, acid-base, ceramic-forming reaction, eg to less than about 100° C. Examples of suitable retardants include pH raisers or buffers such as carbonates, bicarbonates or hydroxides of monovalent metals such as sodium, potassium or lithium, particularly when phosphoric acid is used as the phosphate source. Such a system is described in U.S. Pat. No. 5,830,815, the disclosure of which is incorporated herein by reference. As retardant there may also be used one or more oxidising agent, reducing agent, or any mixture thereof. For example, as described in U.S. Pat. No. 6,133,498, the disclosure of which is incorporated herein by reference, an oxidising agent or a reducing agent can advantageously control the ceramic-forming reaction. It is believed that reduction of the oxidation state of the metal in oxide sources based on transition metals is a primary contributor to this effect. Examples of suitable reducing agents include those listed in the said U.S. patent. As described in the said U.S. patent, boric acid may be used to control the reaction rate.

Solid components of the dispersion will typically include the oxide source and, when present, the clay. It is preferred that any particles have an average effective diameter greater than about 1 μm, for example greater than about 2 μm. Normally, the average effective particle size will be less than about 6 μm, for example less than about 4 μm. In the case of non-spherical particles, particle size is taken as the equivalent spherical diameter of the particle. Particle size may be measured by any technique commonly used in the art, for example dynamic light scattering or transmission electron microscopy.

The insoluble components may suitably be pre-ground to the desired particle size as necessary, by conventional grinding procedures.

The coating composition preferably consists essentially of the oxide source, the phosphate source, water, and optionally one or more of rheology modifiers, buffers, pH reducers, oxidising agents, reducing agents, other cure retardants or surfactants, with less than about 10%, more particularly less than about 5%, by weight of other ingredients.

The oxide source and the phosphate source may be provided at any suitable molar ratio, and the suitable molar ratios will be well appreciated by those skilled in this art, in view of the well-understood chemistry of the phosphate bonding process. For example, the oxide source and the phosphate source may be provided in a molar ratio ranging from about 0.3:1 to about 3:1. The water is preferably the predominant single component of the coating composition, preferably constituting at least about 30% by weight of the composition, eg between about 35 and about 80% by weight.

In one preferred embodiment, the coating composition has substantially the following composition:

water (preferably 45-55 wt %)

phosphoric acid (preferably 15-25 wt %)

chromium trioxide (preferably 1-2 wt %)

chromium oxide (preferably 15-25 wt %)

clay (bentonite) (preferably 0.5-1 wt %)

magnesium oxide (preferably 2-3 wt %)

magnesium hydrogen phosphate (preferably 4-5%).

Such a material is commercially available as IPSEAL (Indestructible Paint Co Limited, Birmingham, UK; web: www.indestructible.co.uk). This material generally requires thermal cure-initiation, typically at about 350° C. for about 1 hour.

The coating composition is prepared by conventional mixing techniques, the components being present in the desired molar ratio, as will be well understood by those skilled in this art. If A and B component parts of the coating composition need to be mixed together immediately prior to application, this will be done in conventional manner.

The composition may be applied to the substrate using any convenient application technique. Typically, spraying, brushing, bade-spreading or roller spreading may be used. In a particularly preferred embodiment, the composition(s) may be applied using a conventional aerosol spraying device comprising a nozzle through which the composition is delivered under pressure, whereby the composition forms an aerosol of fine dispersed droplets in the air.

The coating may be applied in one or more application steps. A single application step is preferred. However, when more than one successive application step is used, the coating will preferably be built up in the successive steps, each step comprising application of a layer (preferably substantially uniform in thickness and continuous) constituting a portion of the coating.

The applied layer of the liquid coating composition will preferably be up to about 25 μm in thickness prior to curing, eg between about 10 and about 15 μm in thickness. Generally speaking, the thickness of the coating layer should be somewhat greater than the particle sizes of the particulate components of the coating composition, to provide an even coating layer prior to curing.

It is preferable for the coating to be applied carefully, to result in a substantially continuous and uniform cover for the surface of the alloy substrate. This assists formation of a well bonded integral diffusion barrier after curing.

The coating may be applied to the whole or any one or more portions of the surface of the titanium alloy substrate or structure. The selection of which surface region or regions require a diffusion barrier will be well within the ability of those skilled in this art.

Following application of the coating to the alloy substrate, the coating may dry naturally before the curing reaction starts. The curing reaction may need to be initiated, as previously described.

The deposited layer is then caused to cure, according to the requirements of the system being used, to form a ceramic diffusion barrier on the substrate.

The ceramic diffusion barrier is preferably in the form of a surface layer overlying the titanium alloy substrate, the layer being typically substantially homogeneous, continuous and of substantially uniform thickness. The thickness of the barrier may depend on factors such as the severity of the ambient conditions to which the protected metallic substrate will be exposed. The barrier preferably has a thickness of greater than about 1 μm, for example greater than about 3 μm, and up to about 20 μm, for example less than about 10 μm, eg an average thickness of about 5 μm.

The diffusion barrier formed according to the present invention may be overlay-coated by one or more further protective coatings, as will be readily apparent to those skilled in this art.

The following example illustrates the present invention, purely by way of example and without limitation. A substrate of a titanium alloy was provided with a 10-15 μm thick diffusion barrier formed of a phosphate bonded ceramic being the thermally (350° C., 1 hour) cured product of the IPSEAL commercial material described above. Oxidation testing in a muffle furnace at temperatures between 650 and 675° C. for up to 600 hours demonstrated an ability of the coating to prevent the formation of visible α-case.

The present invention provides an improved or at least alternative method for protecting titanium alloy substrates against degradation (eg oxidation) damage, particularly but not exclusively in high temperature oxidative or corrosive environments such as aero-engines.

The phosphate bonded ceramic diffusion barrier according to the invention is found to be substantially inert and has sufficient strength and resistance to cracking to maintain its integrity under the wear and vibration conditions typically found in aero-engines. It does not interact adversely with the metallic substrate to an appreciable extent, and hence does not appreciably affect the fatigue properties of the component. It is also resistant to erosion and cracking under repeated cycling from low to high temperatures.

The phosphate bonded ceramic diffusion barrier according to the present invention is normally employed on metallic surfaces as a bonding coat or seal to which other coatings are applied and to act to prevent galvanic corrosion. It is normally applied as a very thin coat, and is not be expected to act as a protective coating by itself. The surprising result provided by the present invention, wherein the coating combines with oxides formed on the surface of the titanium alloy to which it is applied, considerably reduces the extent to which oxygen diffuses into the titanium alloy.

While it is possible to use other components to act as oxygen diffusion barriers most react with titanium in the temperature range in which the present invention is intended to operate.

A common problem with coatings which do not react with the titanium alloy substrate at elevated temperatures (such as aluminium) is that they form oxides (eg $AlO_2$) which are brittle and cause fatigue damage to the surface of the titanium substrate, thereby increasing the propensity of the component to fail.

An additional problem with coating titanium alloy substrates with metallic based coatings is that many metals will diffuse into the substrate and cause fatigue damage.

The above broadly describes the present invention without limitation. Variations and modifications as will be readily apparent to those skilled in this art are intended to be included in the scope of this application and any resultant patents.

The invention claimed is:

1. A method of forming a diffusion barrier on a titanium alloy substrate, the method comprising applying to the titanium alloy substrate a coating comprising a source of a ceramic-forming metal oxide and a source of a phosphate binder for the metal oxide, and causing the metal oxide and the phosphate to cure to form a diffusion barrier comprising a phosphate bonded ceramic on the titanium alloy substrate, wherein the titanium alloy substrate is used in corrosive environments at temperatures above 650° C., and wherein a titanium alloy that is part of the titanium alloy substrate includes one or more components selected from the group consisting of boron, carbon, phosphorous, arsenic, selenium, antimony, and tellurium.

2. A method according to claim 1, wherein the coating is applied in one step.

3. A method according to claim 1, wherein the coating is applied as an acidic aqueous medium comprising the oxide source and the phosphate source.

4. A method according to claim 1, wherein the oxide source is selected from oxides and hydroxides of magnesium, aluminium, iron, chromium, sodium, zirconium and calcium, and any mixture or chemical or physical combination thereof.

5. A method according to claim 1, wherein the phosphate source is selected from phosphoric acid and phosphates of potassium, aluminium, ammonium, beryllium, calcium, iron, lanthanum, lithium, magnesium, magnesium-sodium, magnesium-potassium, sodium, yttrium, zinc, zirconium, and any mixture or chemical or physical combination thereof.

6. A method according to claim 4, wherein the oxide source is selected from magnesium oxide, chromium oxide and mixtures thereof.

7. A method according to claim 3, wherein the acidic aqueous medium further comprises one or more optional additional ingredients.

8. A method according to claim 7, wherein the one or more optional additional ingredient is selected from one or more of rheology modifiers, buffers, pH reducers, oxidising agents, reducing agents, other cure retardants and surfactants.

9. A method according to claim 3, wherein the acidic aqueous medium consists essentially of the oxide source, the phosphate source, water, and optionally one or more of rheology modifiers, buffers, pH reducers, oxidising agents, reducing agents, other cure retardants or surfactants, with less than about 10% by weight of other ingredients.

10. A method according to claim 1, wherein the coating is applied as substantially the following composition: water (45-55 wt %) phosphoric acid (15-25 wt %) chromium trioxide (1-2 wt %) chromium oxide (15-25 wt %) clay (bentonite) (0.5-1 wt %) magnesium oxide (2-3 wt %) magnesium hydrogen phosphate (4-5%).

11. A method according to claim 1, wherein the coating is applied in a thickness of up to about 25 μm.

12. A method according to claim 1, wherein curing of the coating is initiated by heating the coating.

13. A method according to claim 1, wherein the diffusion barrier has a thickness in the range of about 1 to about 10 μm.

* * * * *